United States Patent [19]

Bucher

[11] Patent Number: 4,512,934

[45] Date of Patent: Apr. 23, 1985

[54] AIR BUBBLE HYDROMASSAGING APPARATUS

[75] Inventor: Heinz Bucher, Rottweil, Fed. Rep. of Germany

[73] Assignee: Metronic Electronic GmbH, Fed. Rep. of Germany

[21] Appl. No.: 581,703

[22] Filed: Feb. 21, 1984

[51] Int. Cl.[3] ..... B01F 3/04

[52] U.S. Cl. ..... 261/64 B; 261/122; 251/65; 137/102; 137/528

[58] Field of Search ..... 261/64 B, 122; 251/65; 137/102, 528

[56] References Cited

U.S. PATENT DOCUMENTS

| | | | |
|---|---|---|---|
| 3,076,976 | 2/1963 | Bogar | 261/122 |
| 3,265,062 | 8/1966 | Hesse | 251/65 |
| 3,515,163 | 6/1970 | Freeman | 251/65 |
| 4,269,797 | 5/1981 | Mikiya et al. | 261/122 |
| 4,412,568 | 11/1983 | Hughes | 261/64 B |

FOREIGN PATENT DOCUMENTS

| | | | |
|---|---|---|---|
| 2412441 | 9/1975 | Fed. Rep. of Germany | 261/122 |
| 1955545 | 6/1979 | Fed. Rep. of Germany | 261/64 B |
| 3044880 | 6/1982 | Fed. Rep. of Germany . | |

*Primary Examiner*—Tim Miles

*Attorney, Agent, or Firm*—Thomas W. Speckman

[57] ABSTRACT

An air bubble hydromassaging apparatus having a blower housed in a control unit, a bubble grid adapted to be placed in a bathtub, and air tubing enclosing a check valve to connect the control unit to the bubble grid. The control unit is provided with a bushing type compressed air outlet and the bubble grid is provided with a bushing type compressed air inlet. The air hose has a connector fitting on each end by which it is detachably and airtightly connected to the compressed air outlet of the control unit at one end and to the compressed air inlet of the bubble grid at the other end. A check valve built into the connector fitting serves to obstruct passage through the connector fitting when the blower is inoperative and opens to permit passage through the connector fitting when the blower is operative. Due to the particular construction of the air hose connector fittings and their specially defined association with the compressed air outlet of the control unit and the compressed air inlet of the bubble grid, and further in view of the reflux preventing check valve which is built into one of the air hose fittings, an absolutely safe operation of the device is achieved. The air bubble hydromassaging apparatus is functional only when the proper ends of the air hose are respectively connected to the control unit and the bubble grid, whereby the direction of passage of the check valve is automatically established.

20 Claims, 7 Drawing Figures

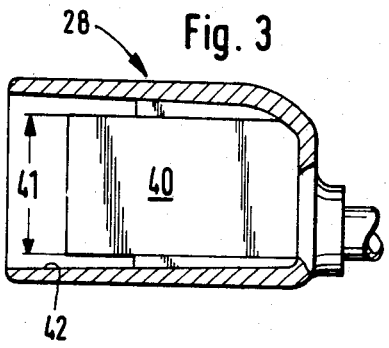
Fig. 3
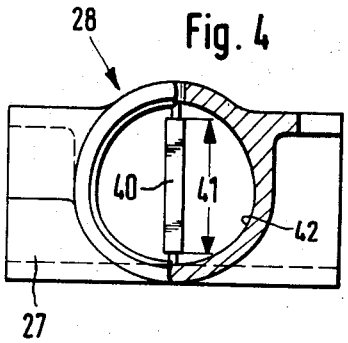
Fig. 4
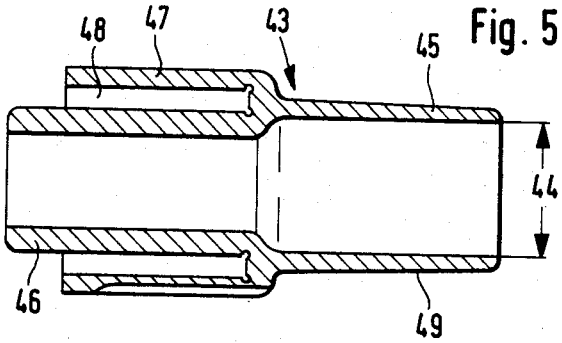
Fig. 5
Fig. 6
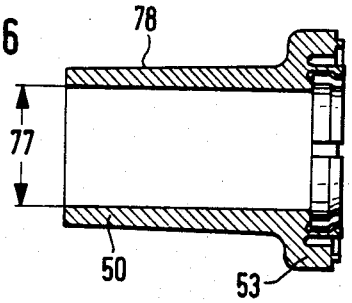

AIR BUBBLE HYDROMASSAGING APPARATUS

BACKGROUND OF THE INVENTION

1. Field of the Invention

This invention relates to an air bubble hydromassaging apparatus comprising a blower housed in a control unit, a bubble grid adapted to be placed into a bathtub, and air tubing including a check valve to connect the control unit to the bubble grid, the control unit being provided with a bushing type compressed air outlet and the bubble grid being provided with a bushing type compressed air inlet. The air tubing has a connector fitting on each end by which it is detachably but airtightly connectible to the compressed air outlet of the control unit at one end and to the compressed air inlet of the bubble grid at the other end. A check valve is built into the connector fitting and serves to obstruct air passage through the connector fitting when the blower is in the OFF condition and opens to permit air passage through the connector fitting when the blower is in the ON condition.

2. Description of the Prior Art

An air bubble hydromassaging apparatus of this general type is known from German Pat. No. 30 44 880. The check valve enclosed in the connector fitting of the air tubing has the advantage that air bubble hydromassaging devices already in use may subsequently be fitted with a check valve of this particular type, simply by replacing the connector fitting of the air hose. In this prior check valve, the valve plunger is returned by a compression spring after the compressed air generator has been turned off. This frequent resetting may cause mechanical problems. Moreover, after some time, the compression spring, due to fatigue, is no longer able to forcibly hold the valve plunger in its closed position with sufficient closing power. Furthermore, the water flowing from the bubble grid back into the valve chamber has no way to drain from the valve chamber, but instead dams up and not only adversely affects the regulation of the valve plunger, but it may even pass into the control unit when the valve plunger is not closing properly. In addition, there is no assurance that the check valve operates properly because the connector fitting which encloses the check valve may also be inserted into the compressed air inlet of the bubble grid. In such case, the check valve is kept closed which may lead the compressed air to back up and thus place an undue load on the blower in operation.

SUMMARY OF THE INVENTION

It is an object of the present invention to provide improvements relating to an air bubble hydromassaging apparatus of the type referred to in the foregoing to ensure that, as the apparatus is first rendered operative or inoperative, the check valve enclosed in the air hose fitting is properly oriented so as to be able to reliably and safely operate even under the most adverse conditions and positively preclude any reflux of water into the control unit.

This is accomplished according to this invention in that the check valve is built into the connector element on the side facing the control unit, which connector element is connectible in an airtight fashion solely to the compressed air outlet of the control unit, that the connector element on the side facing the bubble grid is connectible in an airtight fashion solely to the compressed air inlet of the bubble grid, that the check valve includes a permanent magnet which, when the blower is inoperative, retains the valve plunger which blocks the passage through the connector element, and that, when the blower is operative, the valve plunger is lifted from the permanent magnet by the force of the compressed air exiting from the compressed air outlet of the control unit to permit passage through the connector element.

This embodiment ensures that the air hose can be connected to the control unit or the bubble grid, respectively, only with the proper one of its two connector elements. Thus, after airtight connection between the control unit and the bubble grid has been established, it is also assured that the check valve is operative in the proper direction of passage. The safety factor in the operation of the check valve is substantially enhanced because the permanent magnet maintains the valve plunger in a defined blocking position. The blocking position is only temporarily reversed as an operational requirement by the action of the compressed air generated by the blower, and the check valve resumes its original position immediately after the blower has been turned off. This ensures an optimum of operational safety for the air bubble massaging device.

The unmistakable allocation of the connecting elements of the air hose is accomplished according to one embodiment in that the connector elements of the air hose are each provided with a tapered cylindrical connecting member, that the conical outer contours of the tapered cylindrical connector and the inner contours of the compressed air outlet of the control unit and the compressed air inlet of the bubble grid are identical in shape, that the inner diameter of the tapered cylindrical connector associated with the control unit is smaller than the inner diameter of the connector fitting associated with the bubble grid, and that a blocking element is longitudinally inserted in the compressed air inlet of the bubble grid and is uniformly spaced from opposite inner walls of the compressed air inlet and has a dimension which is greater than the inner diameter of the tapered cylindrical connector of the fitting associated with the control unit, but is smaller than the inner diameter of the tapered cylindrical connector of the fitting associated with the bubble grid. For ease of manufacture, the blocking element is adapted to be inserted as a separate part into the compressed air outlet of the bubble grid, whereby the portion of the blocking element facing away from the orifice of the compressed air connection braces itself against the inner wall of the compressed air connection.

The mechanics of the check valve and its installation in the connector according to one embodiment are such that the connector of the air hose associated with the control unit comprises a tapered cylindrical connector and a hose receptacle, that the hose receptacle includes a socket for the end of the air hose, that the tapered cylindrical connector and the hose receptacle combined form a valve chamber having an enlarged diameter to accommodate and adjustably guide a cage-like valve plunger, that at the transitional section between the tapered cylinder and valve chamber is disposed a permanent magnet in the shape of an annular magnet, that the valve plunger on the side facing the annular magnet has a magnetically conducting washer and at the transitional section between the valve chamber and the hose receptacle is a sealing ring, that in the transitional section between the valve chamber and the hose receptacle drainage orifices are provided, and that in the closed condition, the washer closes off the through bore of the tapered cylindrical connector, and in the open condition the sealing ring of the valve plunger closes the drainage orifices.

In this embodiment, the valve plunger together with the washer and the sealing ring acts as a double valve. When the air compressor is turned on, this double valve assembly opens the passageway from the tapered cylindrical connector to the hose receptacle of the connector fitting of the air hose, but at the same time closes the drainage ports in the valve chamber. When the air compressor is turned off, the passageway from tne cylindrical connector to the valve chamber is closed, and at the same time, the drainage ports in the valve chamber are open. The water flowing back from the bubble grid is thus permitted to flow through the drainage ports out of the valve chamber. As the next cycle commences, it is assured that no water is left in the valve chamber. This type of double valve action imparts increased safety to operation of the check valve, further assisted by the magnetic control. The washer is resilient and has magentically conducting particles dispersed in it.

Installation of the annular magnet according to one embodiment is such that the through bore of the tapered cylindrical connector on the side facing the valve chamber has an enlarged diameter and forms an offset section to serve as a support for the annular magnet, that the annular magnet is held in the offset section by latch springs formed onto the tapered cylindrical connector, and that the tapered cylindrical connector terminates with its portion radially outside the latch springs in a concentric connecting ring for the valve chamber housing formed onto the hose receptacle. In this embodiment, the annular magnet has no sealing function but need only supply enough power to adjust the valve plunger. Fastening of the annular magnet to the offset section is substantially assisted by latch springs on the tapered cylindrical connector because the annular magnet need merely be clamped on.

The washer is fastened on the valve plunger according to another embodiment in that the washer is provided with a center hole, that the valve plunger at the side facing the tapered connector terminates in an open cup-shaped structure, and that latch springs are attached inside the cup and are inserted through the hole in the washer to thereby retain the washer, whereby the diameter of the cup is smaller than the through bore of the tapered cylindrical connector. The center hole of the washer is covered by the cup of the valve plunger so that the washer is attracted by the annular magnet and securely and completely seals off the inlet from the tapered cylindrical connector to the valve chamber.

According to another embodiment, the valve plunger on the side facing the hose receptacle terminates in a guide sleeve which has at its front end a peripheral offset section for supporting the sealing ring, so that the valve plunger can be untiltably guided inside the valve chamber during its adjustment and may easily be connected to the sealing ring which may be made of foam rubber or the like.

To ensure that in the operative condition of the air compressor the compressed air passes through the valve chamber without appreciable loss of pressure, another embodiment provides that tne guide bushing with the offset section for the sealing ring has a center bore whose diameter corresponds to the diameter of the through bore of the hose receptacle.

According to another embodiment, the drainage ports provided in the transitional section between the valve chamber and the hose receptacle first extend axially and then turn radially outwardly. The closing of the drainage ports is further improved according to another embodiment in that the drainage ports on the side facing the washer of the valve plunger are raised from the surface of the transitional section in the manner of a valve seat.

Connection between the hose receptacle and the air hose is accomplished in that the hose receptacle on the side facing away from the valve chamber is provided with two concentric bushings, forming a hollow cylindrical blind hole or socket for the end of the air hose.

In order to connect the tapered cylindrical connector to the hose receptacle in the proper sequence, another embodiment provides that the connecting sleeve of the tapered cylindrical connector and the valve chamber housing of the hose receptacle are provided on the ring-shaped interfaces with mating connecting elements in the form of a tongue and groove. The tapered cylindrical connector and the hose receptacle are centered in the region of the interfaces. Joining may be accomplished by welding, gluing or the like.

BRIEF DESCRIPTION OF THE DRAWINGS

The invention will be further described with reference to the representative embodiments illustrated in the drawings, in which:

FIG. 3 is a longitudinal sectional view at line 3—3 of the compressed air connector of the bubble grid with inserted blocking element;

FIG. 4 is a front view, partly in section at line 4—4, of the compressed air connector of the bubble grid;

FIG. 5 is a longitudinal sectional view of the connector associated with the bubble grid;

FIG. 6 illustrates the tapered member of the connector associated with the control unit.

DESCRIPTION OF PREFERRED EMBODIMENTS

Figure 1:
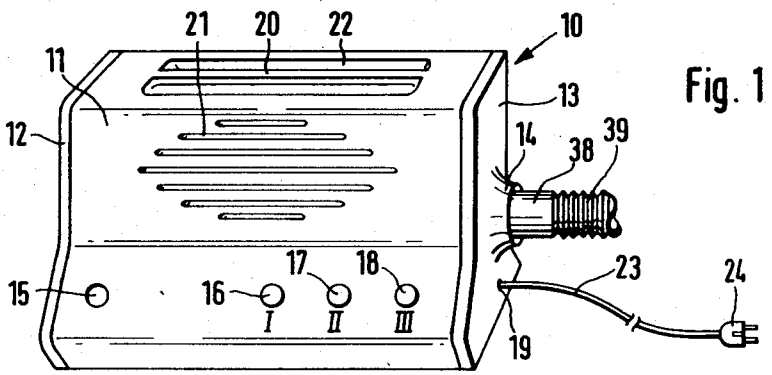
FIG. 1 is a perpsective view of the control unit for an air bubble hydromassaging apparatus according to the invention.

Control unit 10 of FIG. 1 is enclosed in a housing comprising parts 11, 12 and 13. The middle portion 11 of the housing is open on both the left and the right side where it is closed by cover portions 12 and 13, respectively. Disposed on cover portion 13 of the housing is bushing type compressed air outlet 14 which is in communication with the blower inside the housing. The blower is turned on and off by control knobs 16, 17 and 18 and may also be set for different speeds by these controls. A timer may also be provided and controlled by the control unit, set to automatically switch the blower on and off. The operational condition of control unit 10 is indicated by indicating light 15. The electrical components of control unit 10 are connected to a power source by plugging cable 23 with plug 24 into an electrical outlet and actuating the controls to turn on control unit 10. Power cord 23 is inserted through hole 19 into housing portion 13. The front panel of console shaped housing portion 11 has slots 21 through which the air is drawn in by the blower to subsequently be released as compressed air through outlet 14. Depression 22 in housing top 11 has handle 20 for carrying control unit 10. Fitted to compressed air outlet 14 is connector fitting 38 of air tubing or hose 39 which fitting encloses the reflux preventing check valve and which can be connected airtightly only to compressed air outlet 14 of control unit 10, as will be discussed presently.

Figure 2:
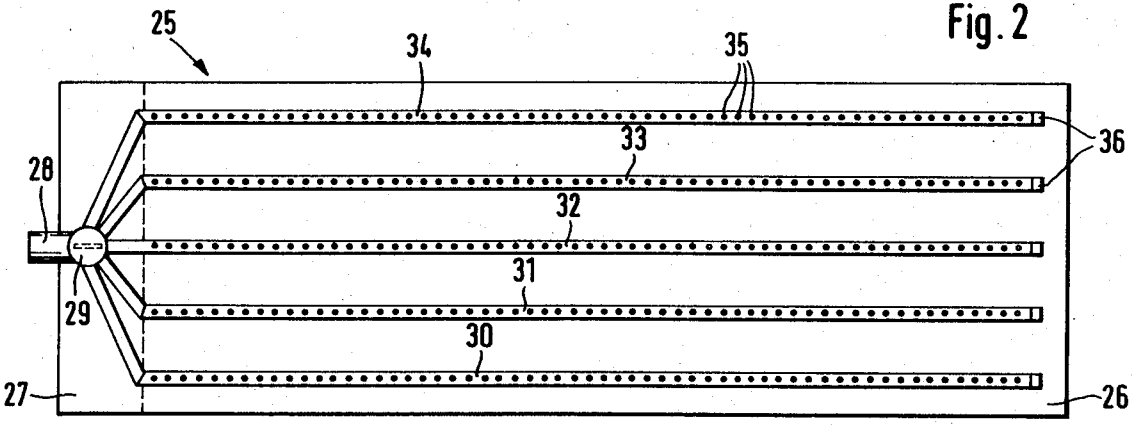
FIG. 2 is a schematic view of the bubble grid of an air bubble hydromassaging apparatus according to the invention.

FIG. 2 shows schematically bubble grid 25 with air distributor 27 and mat 26. Disposed in mat 26 are longitudinally directed spray or bubble channels 30, 31, 32, 33 and 34 with bubble holes 35, which channels converge in pressure distributor 27 into control valve 29. Control valve 29 functions to connect bubble channels 30 to 34 selectively, either individually or in groups, to compressed air connecting element 28 of distributor 27 so that the bubble effect can be directed into smaller or larger areas. Bubble channels 30 to 34 are closed by plugs 36 at their ends opposite from control valve 29 so as to force the compressed air in the channels to escape through bubble holes 35.

As shown in FIGS. 3 and 4, compressed air connector 28 of bubble grid 25 or distributor 27, respectively, includes a flat plate-shaped blocking member or baffle 40 which is mounted longitudinally against inner surface 42 of compressed air connector 28. On the side facing the opening of compressed air connector 28, baffle 40 is reduced to a dimension 41 which is larger than inner diameter 77 of tapered cylindrical connector 50 of connector 38 associated with control unit 10, as shown in FIG. 6, but is smaller than inner diameter 44 of tapered cylindrical member 45 of connector 43 associated with bubble grid 25, as shown in FIG. 5. It is thus possible for bushing type compressed air outlet 14 of control unit 10 and bushing type compressed air inlet 28 of bubble grid 25 to have identical interior configurations which correspond to the outer contours 78 and 49 of the tapered cylinders 50 and 45 of the two connectors 38 and 43, respectively. Nevertheless, only connector 43 is capable of being plugged into compressed air inlet 28 of bubble grid 25 because of baffle 40 inserted into the interior of tapered cylinder 45 of connector 43. However, tapered cylindrical connector 50 of connector 38 having smaller interior diameter 77 cannot be inserted into compressed air inlet 28 of bubble grid 25 because baffle 40, due to its particular dimension 41, is in the way. Thus, airtight connection between compressed air outlet 14 of control unit 10 and compressed air inlet 28 of bubble grid 25 by means of air hose 39 provided with the two connectors 38 and 43 can only be established if connector 38 is inserted into compressed air inlet 14 of control unit 10, and connector 43 is inserted into compressed air inlet 28 of bubble grid 25. It is therefore easy to install the check valve in connector 38 in the proper flow direction.

In connector 43 of FIG. 5, tapered cylindrical member 45 terminates into two bushings 46 and 47 forming socket 48 for the end of air hose 39, into which socket 48 the end of air hose 39 is inserted and retained in an airtight manner.

Figure 7:
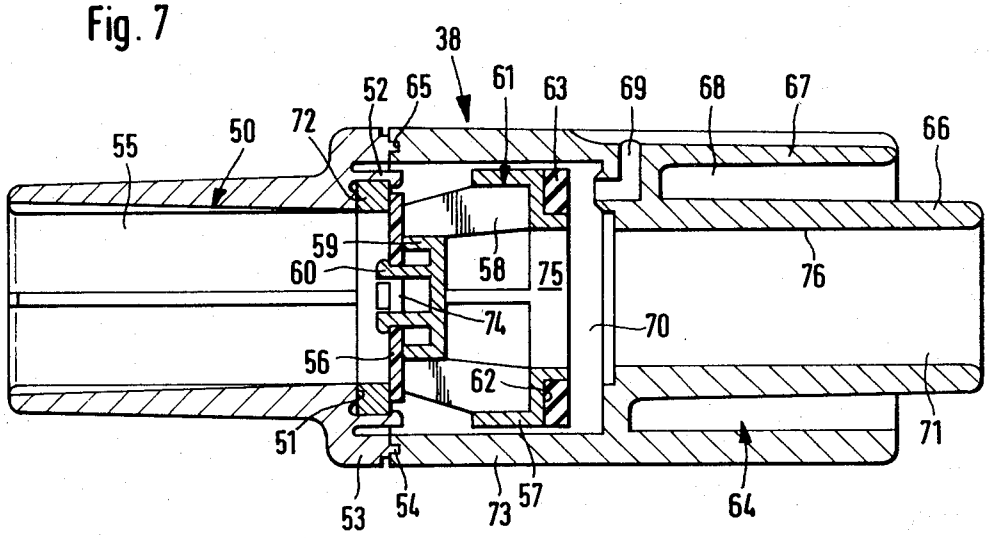
FIG. 7 is an enlarged longitudinal sectional view of the connector with built-in check valve, associated with the control unit.

As shown in FIG. 7, the check valve is built into valve chamber 70 of connector 38 of air hose 39, which connector is designed for use with control unit 10. Connector 38 comprises tapered cylindrical member 50 and air hose socket 64. Tapered cylindrical member 50 is inserted into compressed air outlet 14 on control unit 10 of the air bubble massaging apparatus. As long as the blower is inoperative, bore 55 in tapered cylindrical member 50 remains closed. At the transition from tapered cylindrical member 50 to valve chamber 70, tapered cylindrical member 50 is provided with section 51 of increased diameter which serves as an abutment or support for annular magnet 72. Annular magnet 72 is retained in abutting contact with section 51 by means of latch springs 52 embracing annular magnet 72 at a number of points long its periphery. Springs 52 are molded in one piece with tapered cylindrical member 50. Adjacent springs 52, tapered cylindrical member 50 widens to form a concentric connecting ring 53 which terminates at its connecting face in annular connecting tongue 54.

Hose receptacle 64 terminates on the side facing tapered cylindrical member 50 in hollow cylindrical valve chamber housing 73, the connecting face of which is provided with groove 65 to receive connecting tongue 54 of tapered cylindrical member 50. The end of hose receptacle 64 facing away from tapered cylindrical member 50 is provided with two concentrically disposed sleeves or bushings 66 and 67 between which is formed an elongate hollow annular blind passage 68 to accommodate the end of air hose 39. Tapered cylindrical member 50 is secured to hose receptacle 64 by gluing or welding of the connecting faces which are properly aligned and centered by the connecting elements comprising connecting tongue 54 and groove 65.

Valve plunger 61 is axially movably mounted in valve chamber 70 by means of guide sleeves 57, at the side of valve plunger 61 facing hose receptacle 64. At its side facing tapered cylindrical member 50, valve plunger 61 merges into cup 59 which is open toward tapered cylindrical member 50 and whose diameter is smaller than the diameter of bore 55 of tapered cylindrical member 50. Formed on the side of cup 59 which faces tapered cylindrical member 50 are latch springs 60 which are inserted through center hole 74 of washer 56 and serve to retain washer 56 against valve body 61. The side walls of cup 59 are in abutting contact with washer 56 to positively close off the washer hole.

Resilient washer 56 is rendered magnetically conductive by means of magnetically attractable particles embedded therein and is thus attracted by annular magnet 72. The check valve is in a stable initial position when the blower is inoperative. This position corresponds to the closing or blocking condition of the valve. Passageway or bore 55 of tapered cylindrical member 50 opens into valve chamber 70. A plurality of drainage orifices or ports 69 are provided in the transitional section between valve chamber 70 and hose receptacle 64 to permit water, which might possibly flow back into valve chamber 70, to drain so as to preclude any accumulation of water in valve chamber 70. Ports 69 first are directed axially before they emerge radially from hose receptacle 64. The ends of ports 69, at the side of hose receptacle 64, are in the shape of raised valve seats and can easily be sealed off. Sealing ring 63 is disposed on valve plunger 61 facing hose receptacle 64 and is supported by offset section 62 peripherally extending on guide sleeve 57. Guide sleeve 57 is connected to cup 59 only by longitudinally extending bars 58. The diameter of center bore 75 of guide sleeve 57 corresponds approximately to the diameter of bore 76 of hose receptacle 64.

When the blower is turned on, washer 56 is forcibly removed from annular magnet 72 and the valve plunger is axially movably adjusted until sealing ring 63 closes drainage ports 69 in hose receptacle 64. This establishes a continuous passageway from bore 55 of tapered cylindrical member 50 to bore 76 of hose receptacle 64. In this open position of the check valve, however, valve chamber 70 is tightly closed to prevent any unwanted escape of compressed air. Upon turning the blower off, washer 56 is returned to its original position by the magnetic action of annular magnet 72. The check valve resumes its closed or blocking position. Through bore 55 of tapered stud 50 is closed and drainage ports 69 of valve chamber 70 are open.

I claim:

1. Air bubble hydromassaging apparatus comprising a blower housed in a control unit, a bubble grid adapted to be placed into a bathtub, and air tubing enclosing a check valve to connect said control unit to said bubble grid, said control unit being provided with a bushing type compressed air outlet and said bubble grid being provided with a bushing type compressed air inlet, said air tubing having a first connector fitting on one end and a second connector fitting on the opposite end by which it is detachably and airtightly connectible to said compressed air outlet of said control unit and said compressed air inlet of said bubble grid, respectively, and said check valve being housed in said first connector fitting and serving to obstruct passage through said connector fitting when said blower is in an OFF condition and to permit passage through said connector fitting when said blower is in an ON condition, characterized in that said check valve is housed in said first connector (38) on the side facing said control unit (10), said first connector (38) being connectible in an airtight relation solely to said compressed air outlet (14) of said control unit (10), that said second connector (43) on the side facing said bubble grid (25) is connectible in an airtight fashion solely to said compressed air inlet (28) of said bubble grid (25), that said check valve comprises permanent magnet (72) which in the inoperative condition of said blower retains valve plunger (61) which blocks the passage through said connector (38), and that in the operative condition of the blower said valve plunger (61) is lifted from said magnet (72) by the force of the compressed air exiting from said compressed air outlet (14) of said control unit (10) to permit passage through said connector (38).

2. Air bubble hydromassaging apparatus according to claim 1, characterized in that said first and second connectors (38, 43) of said air hose (39) are each provided with tapered cylindrical members (50, 45), that the conical outer contours of said tapered cylindrical members (50, 45) and the inner contours of said compressed air outlet (14) of said control unit (10) and said compressed air inlet (28) of said bubble grid (25) are identical in shape, that the inner diameter of said tapered cylindrical member (50) of said connector (38) associated with said control unit (10) is smaller than diameter of inner wall (42) of said connector (28) associated with said bubble grid (25), and that a blocking element (40) is longitudinally mounted in said compressed air inlet (28) of said bubble grid (25) and is uniformly spaced from opposite said inner walls (42) of said compressed air inlet connector (28) and has a diameter which is greater than the inner diameter (77) of said tapered cylindrical member (50) of said connector (38) associated with said control unit (10) and is smaller than inner diameter (44) of said tapered cylindrical member (45) of said connector (43) associated with said bubble grid (25).

3. Air bubble hydromassaging apparatus according to claim 2, characterized in that said blocking element (40) is adapted to be inserted as a separate part into said oompressed air inlet (28) of said bubble grid (25), whereby the portion of said blocking element (40) facing away from the orifice of said compressed air connection (28) is braced against said inner wall (42) of said compressed air connector (28).

4. Air bubble hydromassaging apparatus according to claim 3, characterized in that said connector (38) of said air hose (39) associated with said control unit (10) comprises said tapered cylindrical member (50) at one end and hose receptacle (64) at the other end, that said hose receptacle (64) comprises socket (68) to receive the end of said air hose (39), that said tapered cylindrical member (50) and said hose receptacle (64) join to form valve chamber (70) having an enlarged diameter to accommodate and guide said valve plunger (61), that said permanent magnet (72) is in the form of an annular magnet disposed at the transition between said tapered cylindrical member (50) and said valve chamber (70), that said valve plunger (61) on the side facing said annular magnet (72) has magnetically conducting washer (56) and on the opposite side facing the transitional section between said valve chamber (70) and said hose receptacle (64) has sealing ring (63), that in said transitional section between said valve chamber (70) and said hose receptacle (64) drainage ports (69) are provided, and that in the closed condition said washer (56) closes off through bore (55) of said tapered cylindrical member (50), and in the open condition said sealing ring (63) of said valve plunger (61) closes said drainage ports (69).

5. Air bubble hydromassaging apparatus according to claim 4, characterized in that said through bore (55) of said tapered cylindrical member (50) on the side facing said valve chamber (70) has an enlarged diameter and forms offset section (51) to serve as a support for said annular magnet (72), that said annular magnet (72) is held in said offset section (51) by latch springs (52) formed onto said tapered cylindrical member (50), and that said tapered cylindrical member (50) terminates radially beyond said latch springs (52) in a concentric connecting ring (53) for receiving valve chamber housing (73) formed onto said hose receptacle (64).

6. Air bubble hydromassaging apparatus according to claim 5, characterized in that said washer (56) has a center hole (74), that said valve plunger (61) at the side facing said tapered cylindrical member (50) terminates in an open cupshaped structure (59), and that latch springs (60) are formed on the inner side of said cup (59) which springs are inserted through said hole (74) in said washer (56) to thereby retain said washer (56), the diameter of said cup (59) being smaller than said through bore (55) of said tapered cylindrical member (50).

7. Air bubble hydromassaging apparatus according to claim 6, characterized in that said valve plunger (61) on the side facing said hose receptacle (64) terminates in a guide sleeve (57) which has at its front end a peripheral offset section (62) for supporting said sealing ring (63).

8. Air bubble hydromassaging apparatus according to claim 7, characterized in that said guide sleeve (57) with said offset section (62) thereon for said sealing ring (63) has a center bore (75) whose diameter corresponds to the diameter of through bore (76) of said hose receptacle (64).

9. Air bubble hydromassaging apparatus according to claim 8, characterized in that said drainage ports (69) provided in the transitional section between said valve chamber (70) and said hose receptacle (64) first extend axially and then turn radially outwardly in said hose receptacle (64).

10. Air bubble hydromassaging apparatus according to claim 9, characterized in that said drainage ports (69) on the side facing said sealing ring (63) of said valve plunger (61) are raised on said transitional section to form a valve seat.

11. Air bubble hydromassaging apparatus according to claim 10, characterized in that said hose receptacle (64) on the side facing away from said valve chamber (70) is provided with two concentric bushings (66, 67) forming a hollow annular blind passage (68) for the end of said air hose.

12. Air bubble hydromassaging apparatus according to claim 11, characterized in that said connecting ring (53) of said tapered cylindrical member (50) and said valve chamber housing (73) of said hose receptacle (64) are provided on the ringshaped connecting faces with mating connecting elements in the form of connecting tongue (54) and groove (65).

13. Air bubble hydromassaging apparatus according to claim 1, characterized in that said connector (38) of said air hose (39) associated with said control unit (10) comprises a tapered cylindrical member (50) at one end and hose receptacle (64) at the other end, that said hose receptacle (64) comprises socket (68) to receive the end of said air hose (39), that said tapered cylindrical member (50) and said hose receptacle (64) join to form valve chamber (70) having an enlarged diameter to accommodate and guide said valve plunger (61), that said permanent magnet (72) is in the form of an annular magnet disposed at the transition between said tapered cylindrical member (50) and said valve chamber (70), that said valve plunger (61) on the side facing said annular magnet (72) has magnetically conducting washer (56) and on the opposite side facing the transitional section between said valve chamber (70) and said hose receptacle (64) has sealing ring (63), that in said transitional section between said valve chamber (70) and said hose receptacle (64) drainage ports (69) are provided, and that in the closed condition said washer (56) closes off through bore (55) of said tapered cylindrical member (50), and in the open condition said sealing ring (63) of said valve plunger (61) closes said drainage ports (69).

14. Air bubble hydromassaging apparatus according to claim 13, characterized in that said through bore (55) of said tapered cylindrical member (50) on the side facing said valve chamber (70) has an enlarged diameter and forms offset section (51) to serve as a support for said annular magnet (72), that said annular magnet (72) is held in said offset section (51) by latch springs (52) formed onto said tapered cylindrical member (50), and that said tapered cylindrical member (50) terminates radially beyond said latch springs (52) in a concentric connecting ring (53) for receiving valve chamber housing (73) formed onto said hose receptacle (64).

15. Air bubble hydromassaging apparatus according to claim 13, characterized in that said washer (56) has a center hole (74), that said valve plunger (61) at the side facing said tapered cylindrical member (50) terminates in an open cupshaped structure (59), and that latch springs (60) are formed on the inner side of said cup (59) which springs are inserted through said hole (74) in said washer (56) to thereby retain said washer (56), the diameter of said cup (59) being smaller than said through bore (55) of said tapered cylindrical member (50).

16. Air bubble hydromassaging apparatus according to claim 13, characterized in that said valve plunger (61) on the side facing said hose receptacle (64) terminates in a guide sleeve (57) which has at its front end a peripheral offset section (62) for supporting said sealing ring (63).

17. Air bubble hydromassaging apparatus according to claim 13, characterized in that said drainage ports (69) provided in the transitional section between said valve chamber (70) and said hose receptacle (64) first extend axially and then turn radially outwardly in said hose receptacle (64).

18. Air bubble hydromassaging apparatus according to claim 17, characterized in that said drainage ports (69) on the side facing said sealing ring (63) of said valve plunger (61) are raised on said transitional section to form a valve seat.

19. Air bubble hydromassaging apparatus according to claim 13, characterized in that said hose receptacle (64) on the side facing away from said valve chamber (70) is provided with two concentric bushings (66, 67) forming a hollow annular blind passage (68) for the end of said air hose.

20. Air bubble hydromassaging apparatus according to claim 13, characterized in that said connecting ring (53) of said tapered cylindrical member (50) and said valve chamber housing (73) of said hose receptacle (64) are provided on the ringshaped connecting faces with mating connecting elements in the form of connecting tongue (54) and groove (65).

* * * * *